US006635893B2

(12) United States Patent
O'Kane, Sr. et al.

(10) Patent No.: US 6,635,893 B2
(45) Date of Patent: Oct. 21, 2003

(54) SHIELDED CARRYING CASE FOR RADIOACTIVE FLOOD SOURCES

(75) Inventors: Randall O'Kane, Sr., Chagrin Falls, OH (US); Keith C. Allberg, Concord, NH (US)

(73) Assignee: RadQual, LLC, Aurora, OH (US)

( * ) Notice: Subject to any disclaimer, the term of this patent is extended or adjusted under 35 U.S.C. 154(b) by 0 days.

(21) Appl. No.: 09/992,718

(22) Filed: Nov. 14, 2001

(65) Prior Publication Data

US 2002/0060300 A1 May 23, 2002

Related U.S. Application Data

(60) Provisional application No. 60/252,143, filed on Nov. 20, 2000, and provisional application No. 60/252,144, filed on Nov. 20, 2000.

(51) Int. Cl.[7] ..... G21F 5/00
(52) U.S. Cl. ..... 250/506.1; 250/505.1
(58) Field of Search ..... 250/505.1, 506.1, 250/507.1, 515.1, 519.1; 600/3, 7

(56) References Cited

U.S. PATENT DOCUMENTS

| | | | | |
|---|---|---|---|---|
| 4,033,884 A | | 7/1977 | Lorch et al. | |
| 5,550,377 A | | 8/1996 | Petrillo et al. | |
| 5,977,241 A | | 11/1999 | Koloski et al. | |
| 6,048,379 A | | 4/2000 | Bray et al. | |
| 6,121,672 A | * | 9/2000 | Benedetto | 257/660 |

* cited by examiner

*Primary Examiner*—John R. Lee
*Assistant Examiner*—Christopher M Kalivoda
(74) *Attorney, Agent, or Firm*—Fay, Sharpe, Fagan, Minnich & McKee, LLP

(57) ABSTRACT

A bag (10) for transporting radioactive flood sources and the like is formed from a lightweight, multi-layer sheet material comprising a layer (42) of a high-Z, radiation shielding material sandwiched between inner and outer layers (46, 40) of protective material. The radiation shielding material is preferably formed from a lead or tungsten composite comprising a lead or tungsten powder dispersed in a polymer matrix, such as a lead/vinyl composite. The flexible bag is lightweight, allowing the flood shield to be transported easily by handles (26, 28), without the need for maneuvering the bag along the floor on wheels.

25 Claims, 5 Drawing Sheets

SHIELDED CARRYING CASE FOR RADIOACTIVE FLOOD SOURCES

This application claims the priority of U.S. Provisional Application Serial Nos. 60/252,143 and 60/252,144, filed Nov. 20, 2000.

BACKGROUND OF THE INVENTION

The present invention relates to the field of radioisotope cameras. It finds particular application as a carrying case for transporting a flood source, and will be described with particular reference thereto. It should be appreciated, however, that the invention is also applicable to the transport of other radiation sources.

Gamma-ray or scintillation cameras, also known as "Anger cameras" are widely used in medicinal applications to monitor the progress or distribution of a gamma-ray emitting nuclide introduced into a patient. The camera is located adjacent the part or organ of the patient concerned, for instance the brain or liver, and the distribution of the nuclide therein is indicated by the activity at various positions within the organ recorded by the camera.

The gamma camera comprises a gamma-ray sensitive crystal or scintillation crystal, such as a NaI crystal, which absorbs incident gamma rays from the patient under study and interacts with the gamma ray to produce light events. The camera gives a plurality of responses representing particular positions, and related to the position distribution and intensity of the gamma-ray emitting nuclide in the patient. An array of photomultiplier tubes is placed adjacent to the crystal in order to detect and amplify these light events so as calculate the spatial location and energy level of the incident gamma ray to produce a two dimensional image of the object which then may be displayed on a CRT or printed as a hard copy. A multielement collimator in front of the camera is used to view the patient and direct radiation to corresponding parts of the camera during testing. An example of an early radiation camera is shown in U.S. Pat. No. 3,011,057 to Anger and U.S. Pat. No. 3,911,278 to Stout, the disclosures of which are incorporated by reference.

In order to maintain the accuracy of the gamma camera, it is important to calibrate the camera regularly, so that the non-uniformity in the spatial response of the camera can be allowed for in drawing conclusions from the results of diagnostic tests. Cameras can vary in sensitivity by as much as ±15% over their areas, and are usually calibrated daily.

The calibration process includes exposing the gamma camera to a uniform activity in the form of a uniform flood source. This may conveniently comprise a disc, vial, or sheet containing a uniformly dispersed gamma-emitting nuclide, such as Co-57, located in particular spaced relation to the camera to provide a uniform field, whereupon camera readings indicate the sensitivity of the various parts of the camera.

The photomultiplier tubes view the scintillations and generate a resultant image. If the camera is in proper adjustment, the resultant uniform flood image is a uniform image of constant color and intensity. Variations in the color or intensity are indicative of various adjustment and calibration errors in the camera. Errors in the relative gain of the photomultiplier tubes manifest themselves in bright spots under tubes whose gain is higher than the other tubes and dark spots under tubes whose gain is lower than the other tubes.

The most commonly used Co-57 sources have from 1 to 20 mCi of activity. Due to the level of radiation, these sources come in a shielded storage case. Generally, the storage cases are relatively cumbersome and have wheels so that they may be moved from the storage area to the imaging room where the gamma camera is. The cases generally weigh between about 30–40 Kg. Because the cases are difficult to manipulate, nuclear medicine technologists frequently resort to carrying the flood source from the imaging area in their bare hands. This results in a significant radiation exposure, not just to the hands, but also to the vital organs, as the flood source is generally held at chest height.

The present invention provides a new and improved shielded carrying bag and method of use and formation which overcome the above-referenced problems and others.

SUMMARY OF THE INVENTION

In accordance with one aspect of the present invention, a carrying bag for transporting a radioactive source is provided. The bag includes at least one flexible panel comprising an outer layer and a lining formed from a radiation shielding material. The at least one panel is joined together adjacent edges thereof to define an interior space with an upper open end for receiving the radioactive source therein. The bag further includes at least one carrying handle.

In accordance with another aspect of the present invention, a method of transporting a radioactive source is provided. The method includes placing the radioactive source in a bag as described above and transporting the bag by grasping the handle with the hand.

In accordance with another aspect of the present invention, a carrying bag for transporting a flood source is provided. The bag includes a front panel member and a rear panel member. The front and rear panel members are joined along base and side edges to define an interior space with an upper open end for receiving the radioactive source therein. The front and rear panel members each include an outer layer, an inner layer, and a lining formed from a radiation shielding material between the inner and outer layers. An upper panel member shaped to cover the upper open end when the flood source is positioned within the interior space. The upper panel is connected with the rear panel member. A closure member is provided for selectively fastening the upper panel to the front panel to close the opening.

In accordance with another aspect of the present invention, a method of forming a bag for shielding a flood source is provided. The method includes covering a sheet of a radiation shielding material with a sheet of fabric to form a radiation shielding panel and folding the radiation shielding panel to define a front panel member, a rear panel member and a top panel member. The method further includes attaching the front panel member to the rear panel member along side edges thereof and forming a closure member, a first portion of the closure member being associated with the top panel member and a second portion of the closure member being associated with the front panel member. The closure member is configured for selectively engaging the top panel member and front panel member.

One advantage of at least one embodiment of the present invention is the provision of a bag which is easy to carry, and thus more likely to be used by a nuclear medicine technologist than conventional, wheeled carrying cases.

Another advantage of at least one embodiment of the present invention is that the bag is provided with carrying handles which space the radiation source from the technician and also allow the bag to be transported at the technicians side, away from the vital organs in the technician's chest. This reduces the radiation exposure of these organs.

Yet another advantage of at least one embodiment of the present invention is that the bag is lightweight.

A still further advantage of the present invention is that the bag can be used as a shipping case, for transporting a flood source from a manufacturer to a supplier or to the facility where it is to be used, as well as a carrying case for transport between a storage area in the facility and a camera.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
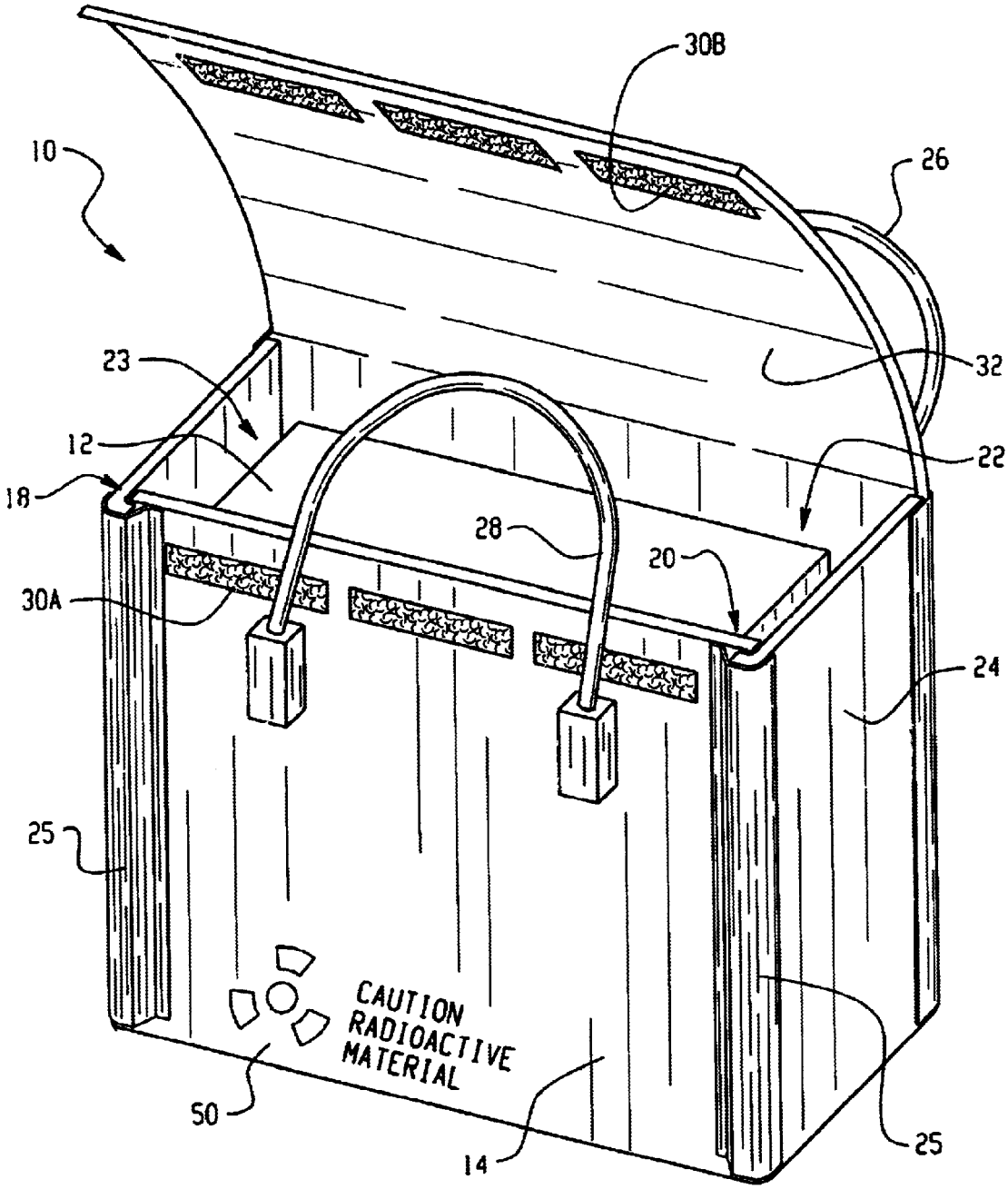
FIG. 1 is a perspective view of a shielded carrying bag according to the present invention.
Figure 2:
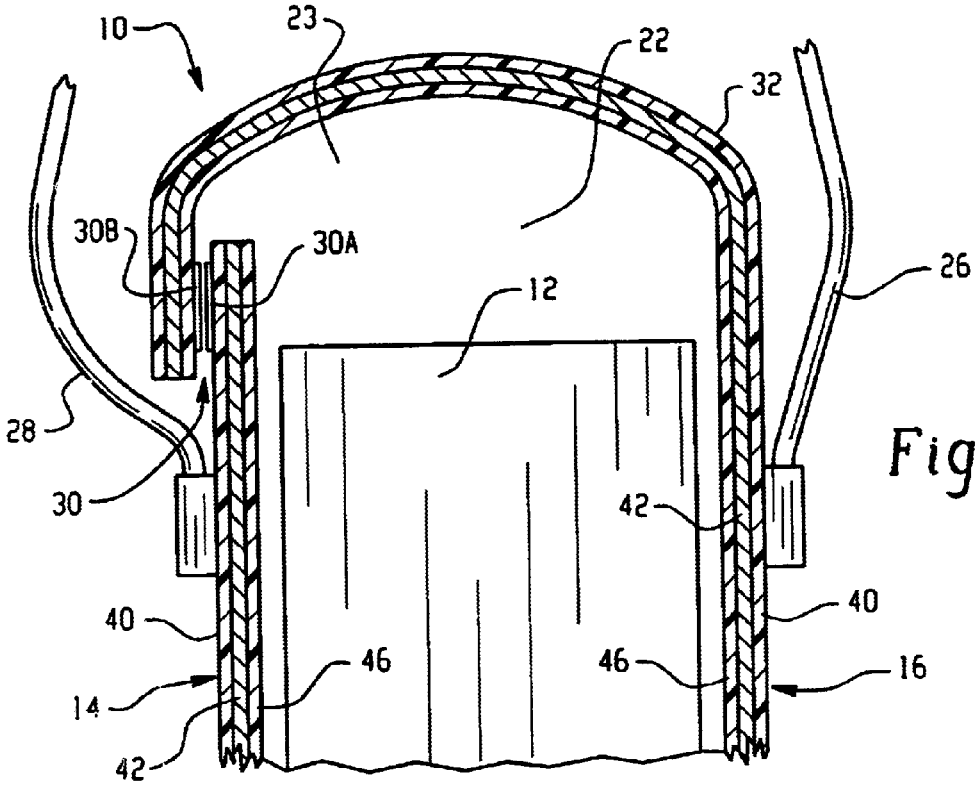
FIG. 2 is a front view of the bag of FIG. 1.
Figure 3:
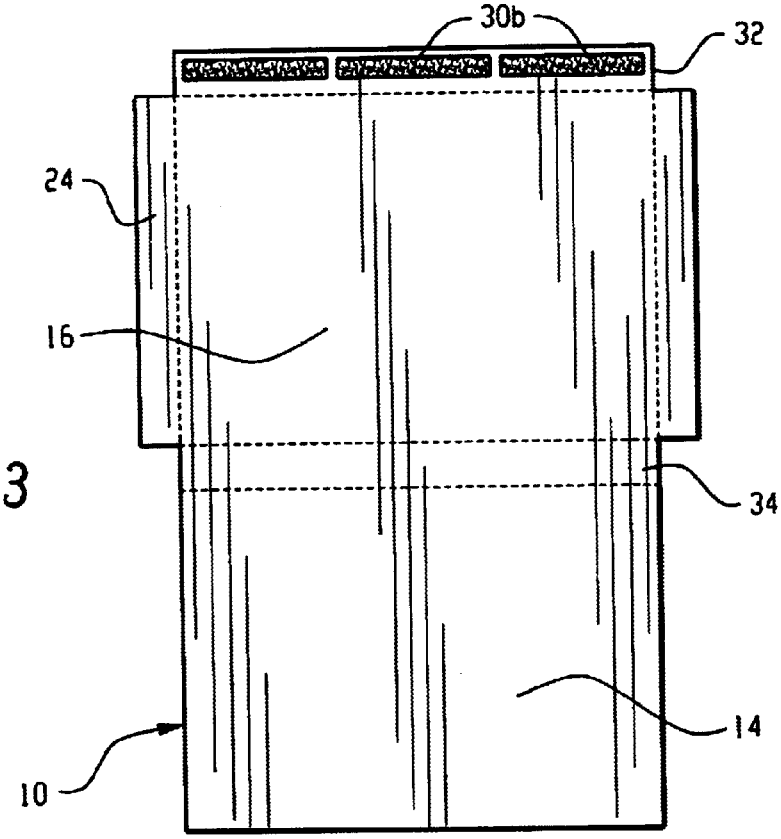
FIG. 3 is a side sectional view of the bag of FIG. 1.

With reference to FIGS. 1–3, a shielded carrying bag 10 for transporting a radiation source 12, such as a uniformly distributed radiation source, or flood source, is shown. The bag is of a soft-sided, multi-layer construction and includes a front panel portion 14 and a rear panel portion 16, which may be integrally formed as a single panel, as shown in FIG. 3. The panel portions are connected together at side edges 18, 20 to define an interior space 22 for receiving the flood source through an opening 23 in an upper end thereof. As shown in FIG. 3, one of the panels 16 is preferably wider than the other to provide side portions 24. The side portions fold over the other panel along side edges. The edges may be held together with adhesive, by welding or sewing, or the like. In a preferred embodiment, the edges are sewn together with a canvas or other tape 25.

Carrying handles 26, 28, or other suitable carrying members are provided at the upper end of each of the panels 14, 16 to allow the bag to be transported easily. As shown in FIG. 1, the handles may be in the form of a strap, attached at either end to the panel, and formed from any suitable handle material, such as leather, fabric, or plastic coated fabric.

A closure member 30, is provided which preferably comprises pieces of hook and latch material, e.g. Velcro™, sewn on to the canvas. For example, one panel portion 16 of the bag may be made slightly longer than the other panel portion 14 to provide a fold-over portion 32, which folds over the other panel at the top. One or more Velcro strips 30A and 30B are sewn or otherwise attached along the mating surfaces of the front panel portion and fold over portion to releasably attach the panel portions 14, 16 together at the top. This reduces radiation emission from the upper open end 23 of the bag when the flood source is being transported. Other closure members, such as zippers, buttons, hooks, or the like may alternatively be employed to close or partially close the upper open end of the bag.

Figure 4:
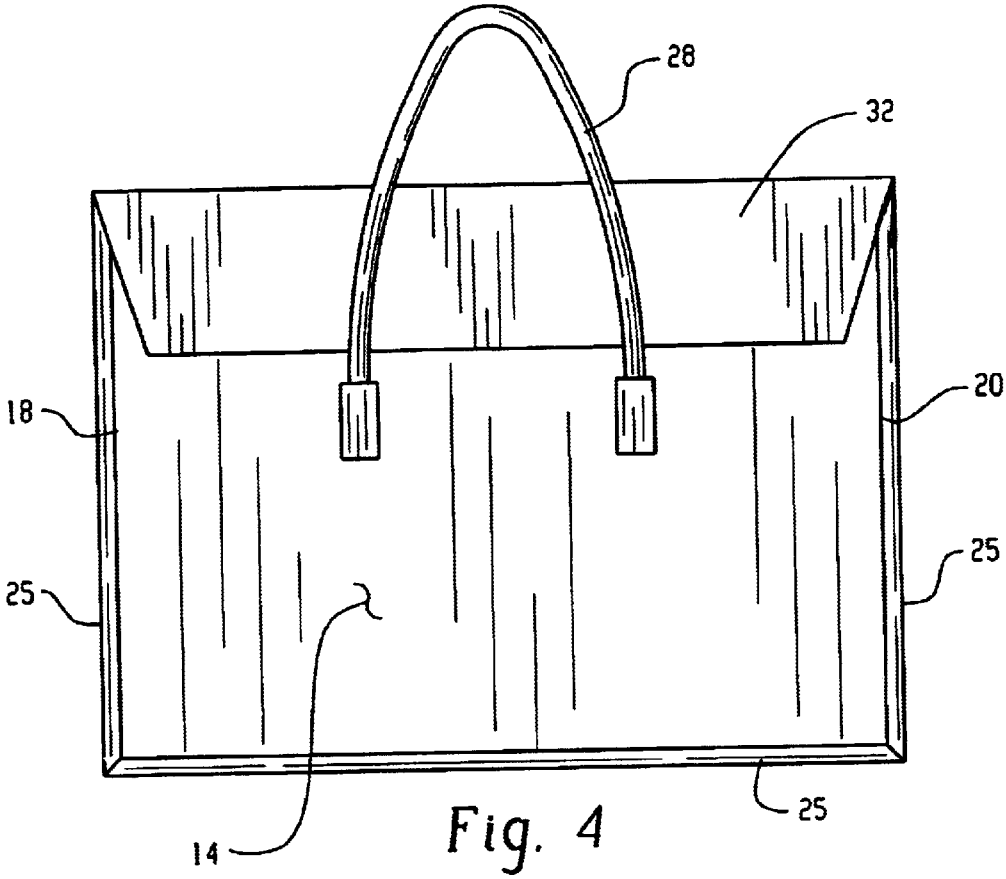
FIG. 4 is a side view of an alternative embodiment of a shielded carrying bag according to the present invention.
Figure 5:
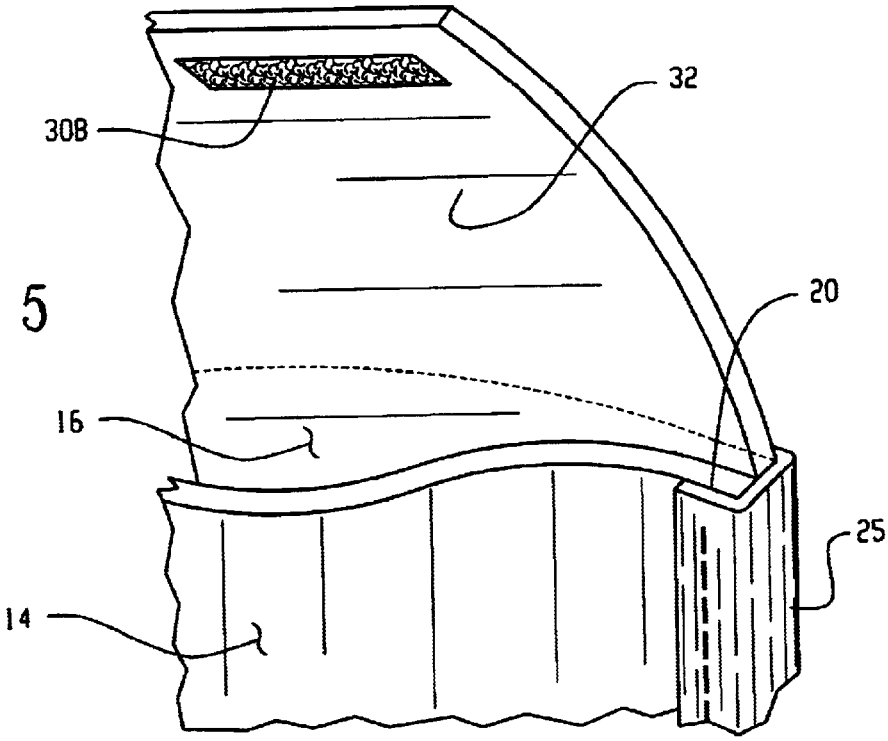
FIG. 5 is an enlarged perspective view of the carrying bag of FIG. 4.

In an alternative embodiment shown in FIG. 4, the side portions 24 and optionally the bottom panel 34 are eliminated and the front and rear panels 14, 16 are of the same width and are bound (e.g., by sewing) together along their side edges 18, 20 with tape 25, as shown in greater detail in FIG. 5, to define the interior space 22.

The bag is preferably dimensioned to accommodate one or more commercially available flood sources 12, which may be in the shape of a disk, vial, or sheet. Commonly used flood sources comprise a rectangular sheet, and the panel portions 14, 16 are preferably rectangular and slightly larger in dimensions than the largest flood source to be accommodated. Suitable dimensions for such a bag are about 60 to 80 cm wide, more preferably, about 70 cm wide, and about 40–60 cm high, more preferably, about 50 cm high for the larger panel portion 16, the smaller panel portion 14 being about 2–3 cm narrower on each side of the width to allow for overlap of the wider panel portion. A bottom panel portion 34 of about 2–3 cm may be provided with the same width as the larger or smaller panel portion.

The bag 10 includes a radiation shielding material, which reduces the emission of radiation from the radiation source. As shown in FIG. 2, the panel portions 14, 16, 32, 34 preferably comprise a multi-layer construction, having a first, or outer layer 40 formed from a supporting material or fabric, such as a woven or nonwoven fabric, e.g., canvas, mesh, fiber-impregnated polymer materials, plastic, felt, or a padded material, such as a plastic or fabric-coated foam, or the like. Polyvinyl is a particularly preferred material. The thickness of the outer layer 40 may be from about 1–3 mm. The term "fabric" is used herein to encompass all such lightweight, flexible, foldable materials which may be used in the formation of a bag. The first layer may be used to protect the radiation shielding material from damage and to provide a structural support for the bag. The outer layer also serves as a suitable material for attaching handles, closure members, and the like thereto.

A second layer or lining 42 is formed from a radiation shielding material. By "radiation shielding," it is meant to include filtering, such as when the intensity of the electromagnetic radiation is partially reduced, as well as blocking, such as when the electromagnetic radiation is completely absorbed by the radiation shielding material. Preferably, the radiation shielding material shields at least 50% of the radiation, more preferably 70% of the radiation, and most preferably, shields at least 80–85% of the radiation (i.e., about 15–20% or less of the radiation is emitted. While such emission levels could be harmful to a human on long term exposure, the short period of exposure (during carrying to and from the camera) and the position of the source (at approximately knee height) results in an exposure which is considerably less harmful than often occurs when a technician carries a flood source at chest height without using shielding of any kind.

The panel portions 14, 16, 32, 34 preferably include an inner third layer 46, located adjacent to the flood source, to protect the source from accidental damage by the radiation shielding material and/or to provide structural support for the panel. Since the radiation shielding material may shed dust if rubbed, the inner layer 46 also prevents this dust from coming into contact with and damaging the flood source.

The third layer may be made from the same material as the first layer or from a different material. The lining 42 may be attached to the inner and/or outer layer by welding, glued with an adhesive, bonded by partial melting of the inner or outer layer, joined by seaming the lining and outer and/or inner layers together at the edges, or formed by deposition of the lining material onto the inner or outer layer or deposition of the inner or outer layer onto the lining. For example, the lining material may be formed by rolling, extruding or other layer forming process and then adhesively or otherwise attached, or may be laid down on the inner or outer layer in the form of a slurry, which is allowed to dry and form an adhered layer. Or, the inner and outer layers may be deposited as fibers on the liner and attached by adhesive, heat welding, or the like. Alternatively, the lining may be simply enclosed between the inner and outer layers. A particularly preferred method includes extruding the lining and joining the edges of the lining and inner and outer layers together by sewing them together using a canvas or other tape 25 to enclose the exposed edges of the lining and the inner and outer layers.

A logo or other indicia 50 on the outside of the outer layer may provide information about the contents of the bag, e.g., internationally accepted symbols indicating that the bag contains radioactive materials.

Because of the soft-sided construction of the bag, it packs relatively flat. However, the flexible sides can be pulled apart from each other as necessary to allow the flood source to be inserted. The flood source 12 preferably contains a uniformly dispersed radiation emitting material, in the case of a gamma camera, a gamma-emitting nuclide. Suitable nuclides include Cobalt-57, which has half life of 270 days, and emits gamma-rays at 122 and 136 KeV, or Gadolinium-153, which has a half life of 242 days and emits gamma-radiation at 99 and 101 KeV.

The radiation emitting material is present in sufficient quantity to act as a flood source for a radiation camera, such as a gamma camera. For example, in the case of Co-57, the flood source may have from about 1 to 20 mCi of activity, or more.

The gamma camera (not shown) typically includes a scintillation crystal, such as a NaI crystal, which absorbs incident gamma rays from the flood source and interacts with the gamma ray to produce light events. An array of photomultiplier tubes is placed adjacent to the crystal in order to detect and amplify these light events so as calculate the spatial location and energy level of the incident gamma ray to produce a two dimensional image of the flood source, which then may be displayed on a CRT or printed as a hard copy. The flood source, in which radiation emitting material is preferably uniformly distributed, produces a uniform image for calibration of the camera.

The flood source 12 is carried from a storage area to an imaging room in the shielded bag 10. It is removed from the shielded carrying bag when a calibration process is to be carried out. The calibration process includes exposing the gamma camera to the flood source. The photomultiplier tubes view the scintillations and generate a resultant image. If the camera is in proper adjustment, the resultant uniform flood image is a uniform image of constant color and intensity. Variations in the color or intensity are indicative of various adjustment and calibration errors in the camera.

When not in use, the flood source may be stored in its bag 12 inside an additional radiation shielding storage container (not shown) of the type commonly used for storing flood sources.

The selection and thickness of the radiation shielding material forming the lining 42 depends on the radiation material to be carried. Suitable materials for forming the radiation shielding material include lead and other materials having a high Z number. By high Z, it is meant that the material has a high electron density within the atom. The thickness of the high Z material depends upon the energy of the source.

High Z materials suitable for shielding gamma rays, high-energy ultraviolet light, and x-rays include lead, tungsten, gold, bismuth, copper, cobalt, tantalum, nickel, or silver, as metals, alloys, or compounds thereof, either alone or in combination with other high Z materials. Lead is an effective High Z material. Tungsten is particularly effective as a lead substitute material since, in addition to being comparatively non-toxic, it has a very high density (19.25 g/cc). Commercially available tungsten powders can therefore be mixed and pressed with softer and lighter non-toxic metals, such as tin or zinc, to generate lead substitute materials with a range of densities as high as, or even higher than, that of lead. Kovar™ and copper/tungsten alloys may also be used.

Or, a High Z material as described above may be incorporated into a matrix material, such as a polymer to form a composite. Suitable composites are those which include a High Z material, such as tungsten powder or lead, embedded in a binder, optionally with fibers, such as stainless steel fibers. The High Z material may comprise between about 5% and about 95% of the composite weight, more preferably, between about 15% and about 70% of the composite weight, most preferably, between about 35% and about 40% of the composite weight. The tungsten, lead or other High Z material, may be introduced to the binder in the form of a powder, the powder particles having a mean size of between about 2 and about 40 microns in diameter, more preferably, a mixture of particles, a first group having a size of between about 4 and about 8 microns in diameter, and a second group of particles having sizes of between about 20 microns and 40 microns.

The fiber, where present, may comprise between about 3% and 30% of the composite weight, more preferably, between about 10% and 20% of the composite weight, most preferably, between about 15% and 18% of the composite weight. The fibers may be stainless steel, or other metallic fibers such as copper, nickel, niobium, nickel, or titanium or non-metallic, such as nylon, Kevlar™, Spectra™, glass, boron, or carbon, either alone or in combination with other fibers or as a mixture in the fibers. The non-metallic fibers, such as glass fibers, Kevlar™, Spectra™, glass, carbon, graphite, or boron may be used to increase the tensile strength of the composition. A particularly preferred fiber is a stainless steel fiber.

Suitable binders include polymeric binders, which can be homopolymers, copolymers, multicomponent polymers, or combinations thereof. Exemplary polymers include polyvinyls, polyurethane prepolymers, celluloses, fluoropolymers, ethylene inter-polymer alloy elastomers, acetates, such as ethylene vinyl acetate, nylon, polyether imides, polyester elastomers, polyester sulfones, polyphenyl amides, polypropylene, polyvinylidene fluorides or thermoset polyurea elastomers, acrylics, homopolymers, acrylonitrile-butadiene-styrene copolymers, thermoplastic fluoro polymers, ionomers, polyamides, polyamide-imides, polyacrylates, polyaryl-sulfones, polybenzimidazoles, polycarbonates, polybutylene terephthalates, polyether imides, polyether sulfones, thermoplastic polyimides, thermoplastic polyurethanes, polyphenylene sulfides, polyethylene, polysulfones, polyvinylchlorides, styrene acrylonitriles, polystyrenes, polyphenylene ether blends, styrene maleic anhydrides, polycarbonates, cyanates, epoxies, phenolics, unsaturated polyesters, bismaleimides, polyurethanes, silicones, vinylesters, urethane hybrids, and combinations thereof. Particularly preferred binders are polyvinyls and Nylon, preferably Nylon 12™ alone or in combination with a polyester elastomer.

Combinations of binder materials, such as thermoplastic and thermoset materials, may be used as the polymeric binder. Each type of binder material may be used to vary the physical properties of the composite, for example from very hard to soft and flexible. In certain embodiments, the binder may be a hot melt or thermosetting type of glue. In particular embodiments, the thermoset may comprise a single component whereas in other embodiments, the thermosets comprise a plurality of components.

The binder may be present at between about 1% to about 30% of the composite weight, more preferably, between about 2% to about 20% of the composite weight, most preferably, between about 8% to about 12% of the composite weight.

The polymer matrix, in addition to an organic based polymer or an inorganic-organic hybrid polymer, and optionally fibers, can contain a variety of materials which are known in the art to modify the properties of the polymer matrix. These include, fillers, cross-linking agents, stabilizers, radical scavengers, compatabilizers, antistatic agents, dyes, and pigments.

To form the composite, the high-Z material, such as tungsten or lead powder is preferably mixed with the bulk component of a two-part curing resin system, such as an epoxy resin. The resultant mixture, having the viscosity of a caulking compound, is easily stored until ready for use. Prior to application, a catalyst is added and the mixture is thoroughly stirred. The material may then be extruded to form a thin layer of generally uniform thickness. The mixture is then allowed to cure and cut to the appropriate size, either before or after sandwiching between the inner and outer layers 46, 40 of the bag.

Or the mixture may be applied directly to a surface, for example on to the inner or outer layer 46, 40 of the panel (either as a cut piece or in a longer length which is then cut to the appropriate size for forming the panel. The mixture is then allowed to cure.

Suitable composite materials of this type comprise a lead/vinyl compound sold by Wolf X-Ray, Vulcan Lead or Bar Ray, and a lead powder dispersed in a proprietary resin matrix sold under the tradenames EVAL-10 and Xenolite by Xenoprene Co. Of Toronto, Ontario. Suitable lead vinyl materials are about 1–3 mm in thickness and have a density of about 11–20 g/cm$^3$.

Other suitable composite materials of this type are sold under the tradename Ecomass® Compounds and are available from M.A. Hanna Engineered Materials, Norcross, Ga. 30071. These and other suitable polymer composite materials are described in U.S. Pat. No. 6,048,379 and comprise nontoxic, high-density, thermoplastic composite materials that can be processed on conventional injection molding, compression molding, and extrusion equipment. Available Ecomass® Compounds are formulated using a variety of polymers and fillers having an overall density of up to about 11.0 g/cc and yield strengths of up to about 7500 psi, which is much greater than lead. Suitable examples include Ecomass® Compound NJ-96TP, NJ-77TP-17MN/000 NATURAL, NJ-77TP-17MN/000 NATURAL. They exhibit an X-ray shielding capacity essentially equal to that of lead.

Other polymer composites may be used wherein a polymer matrix has natural free volume therein with an inorganic or organic material disposed in the natural free volume of the polymer matrix. Such materials are disclosed in U.S. Pat. No. 5,977,241.

The polymer matrix for these free-volume composites can be an organic based polymer, such as one or more of those listed above, or an inorganic-organic hybrid polymer. Particularly preferred for this application are halopolymers, such as fluoropolymers and fluorochloropolymers. Halopolymers are organic polymers which contain halogenated groups, such as fluoroalkyl, difluoroalkyl, trifluoroalkyl, fluoroaryl, difluoroalkyl, trifluoroalkyl, perfluoroalkyl, perfluoroaryl, and the like and include fluorohydrocarbon polymers, such as polyvinylidine fluoride ("PVDF"), polyvinylfluoride ("PVF"), polychlorotetrafluoroethylene ("PCTFE"), polytetrafluoroethylene ("PTFE") (including expanded PTFE ("ePTFE"). Suitable fluoropolymers include perfluorinated resins, such as perfluorinated siloxanes, perfluorinated styrenes, perfluorinated urethanes, and copolymers containing tetrafluoroethylene and other perfluorinated oxygen-containing polymers like perfluoro-2, 2-dimethyl-1,3-dioxide (which is sold under the trade name TEFLON-AF). The polymer matrix can, alternatively, be an inorganic-organic hybrid polymer or blend of organic polymer and inorganic-organic hybrid polymer.

The bag thus formed is lightweight and easy to carry by grasping one or both of the handles by the hand and lifting the bag off the floor. The bag is then carried by hand, at approximately knee height, to or from the camera. As can be appreciated, there is no need to provide the bag with rotatable members, such as wheels, casters, or the like, for wheeling the bag along the floor, due to its lightweight construction.

Preferably, the bag 10 has a weight of under about 12 kg, more preferably under 10 kg, most preferably, from about 6 kg to about 10 kg. For example, the shielding layer may have a thickness of about 0.1 mm to about 3 mm, more preferably, about 0.4–1.25 mm for lead or about 1.75 mm for Ecomass® Compounds. These thicknesses are suitable for Co-57 flood sources. For example, a bag formed from Ecomass® having a density of 8 g/cm$^3$ with an area of 1367.62 cm$^2$ will weigh about 11 kg (excluding the weight of fabric layers, handles, Velcro™, etc.) A slightly smaller bag formed from a lead liner having a density of 11.34 g/cm$^3$, a thickness of 1.778 mm and an area of 976.87 cm$^2$ will also weigh about 11 kg (excluding the weight of fabric layers, handles, Velcro™, etc.) If liner material is made thinner, for example, approximately 0.5 mm in thickness, the weight of the bag will be correspondingly less.

It may be desirable for a facility to have different sized bags or different thicknesses of the High-Z material for different sized or intensity flood sources. For example, one bag may be 21 inches×22 inches (53.3×55.9 cm), and have a total weight of about 11 lbs (5 kg), for accommodating flood sources up to about 20×21 inches, a second bag may be 26 inches×19.5 inches, with a weight of 12 lbs, for accommodating flood sources up to about 25×19 inches, a third bag may be 26 inches×9.5 inches with a weight of 20 lbs for accommodating higher intensity radiation flood sources up to about 25×21 inches.

Figure 6:
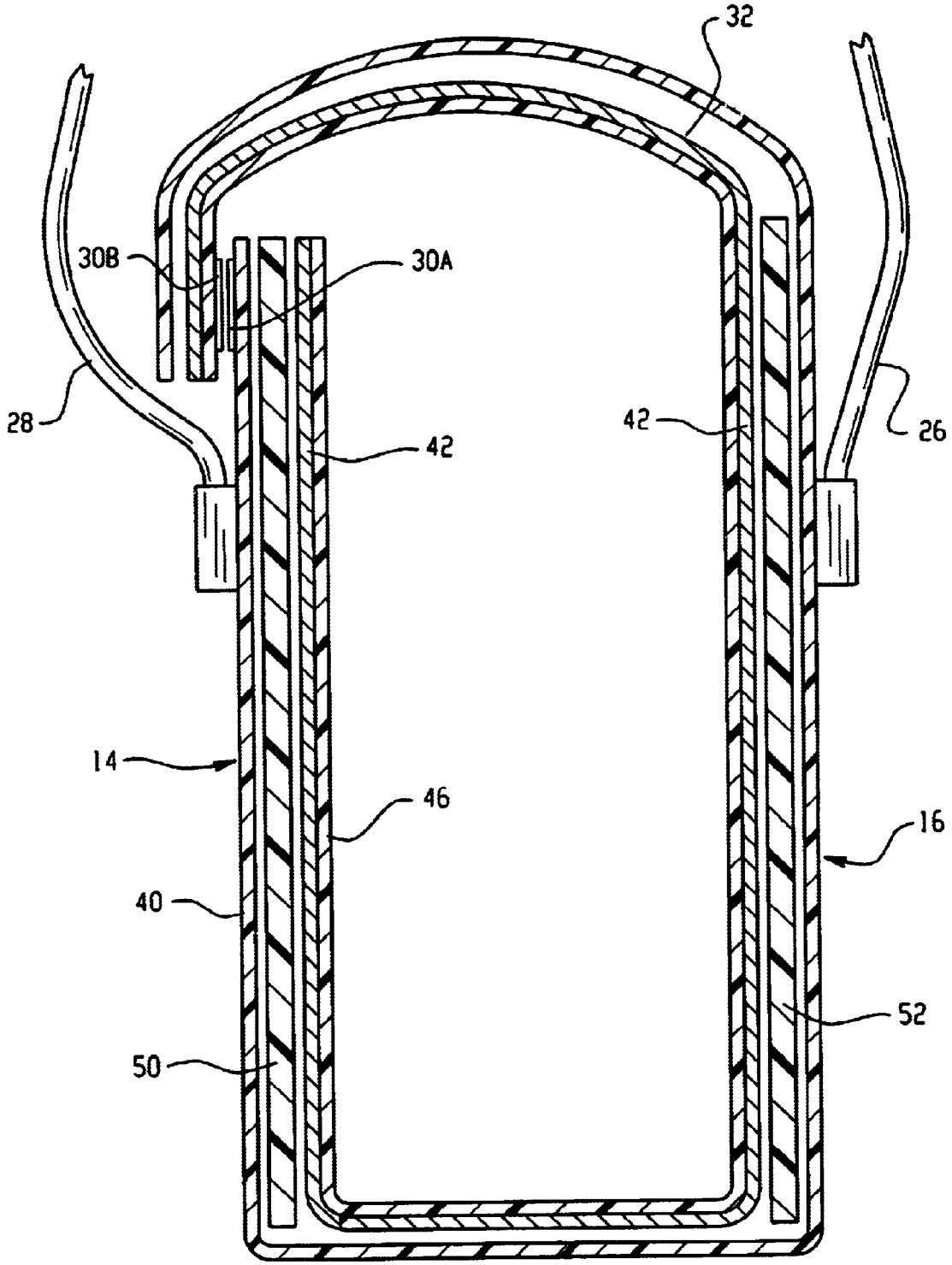
FIG. 6 is a side sectional view of an alternative embodiment of a shielded carrying bag.

In some circumstances, it is desirable to make the bag sufficiently rigid that it can retain its own shape. This allows the bag to be put on the floor, a table, or other support surface and the flood source to be lowered inside. The flexibility of the shield bag can be altered either by adjusting the polymer used for the extruded lead shielding or simply by inserting a mechanical stiffener (e.g., a sheet of plastic or metal) to obtain the desired flexibility. This does not add significantly to the weight of the bag. It can still be carried around by a shoulder strap or carrying handle. Moreover, the bag is still sufficiently flexible for the fold-over portion 32 to be folded over and for the sides of the bag to flex, as needed, to accomodate different sizes of flood sources. FIG. 6, by way of example, shows a carrying bag with two rectangular sheets 50, 52 of plastic or metal, which are positioned between the outer layer 40 and the lining 42 of radiation shielding material, although it is to be appreciated that the stiffening layers may be positioned elsewhere in the bag or adjacent the inner layer 46. The bag is otherwise similar to that shown in FIGS. 1–5. It is to be appreciated that the width of the layers is shown enlarged for ease of illustration.

Figure 7:
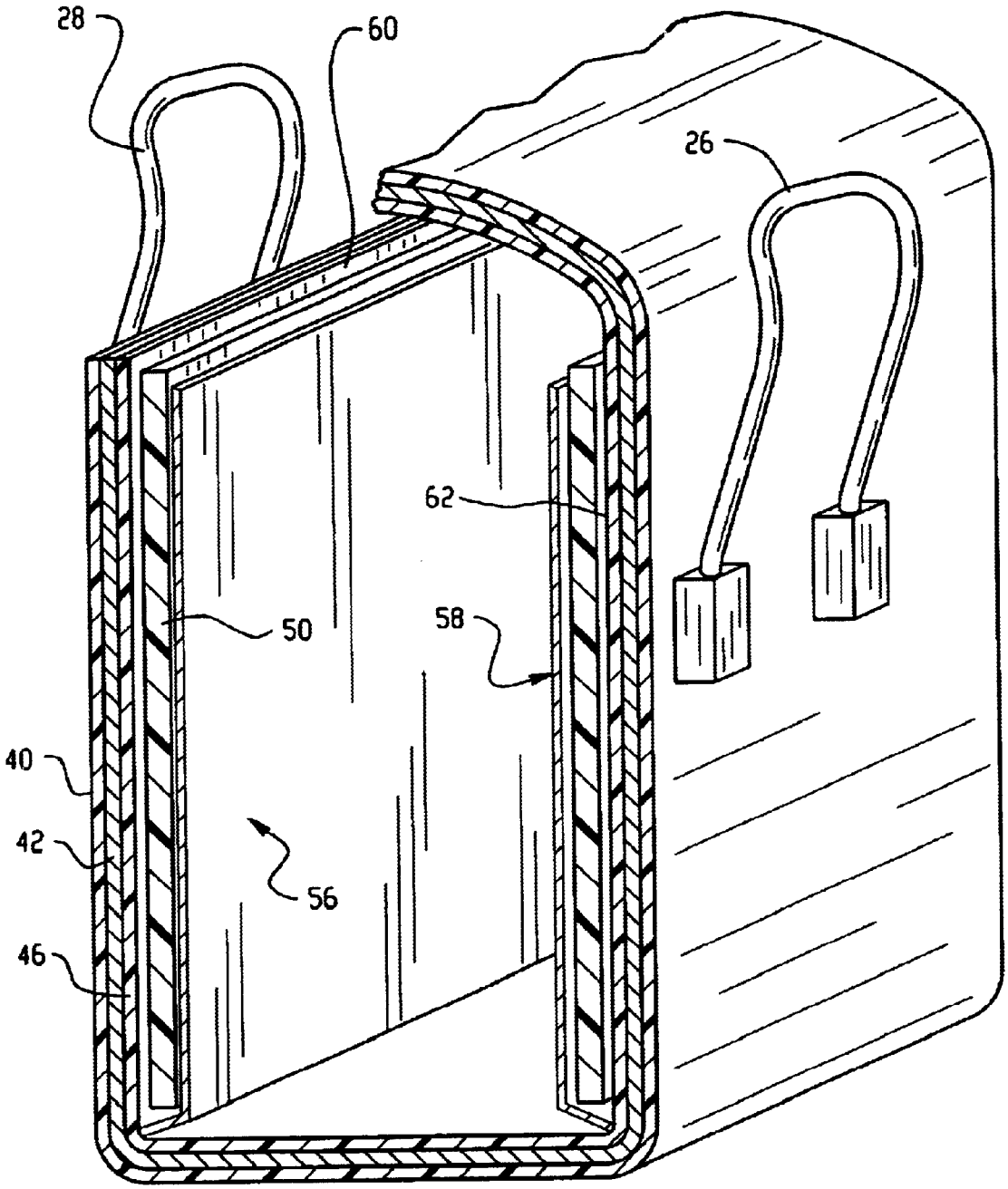
FIG. 7 is a perspective side sectional view of another alternative embodiment of a shielded carrying bag.

The stiffening layer or layers 50, 52 may be adhesively attached or otherwise joined to the adjacent layer or layers. Or, as shown in FIG. 7, the sheets 50, 52 may be slipped in to a suitably shaped pocket or pockets 56, 58, attached, for example, to inward-facing surfaces 60, 62 of the inner layer. Having the stiffening layers 50, 52 inserted in a pocket or pockets allows them to be removed, if desired, and replaced when needed.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A carrying bag for transporting a radioactive source comprising:

at least one flexible panel comprising:

an outer layer;

a lining formed from a radiation shielding material, the at least one panel being joined together adjacent edges thereof to define an interior space with an upper open end for receiving the radioactive source therein; and at least one carrying handle.

2. The carrying bag of claim 1, wherein the radioactive source comprises a flood source.

3. The carrying bag of claim 1, wherein the bag has a weight of less than 12 kg.

4. The carrying bag of claim 3, wherein the bag has a weight of less than 10 kg.

5. The carrying bag of claim 1, wherein the radiation shielding material includes a High-Z material selected from the group consisting of lead, tungsten, gold, bismuth, copper, cobalt, tantalum, nickel, silver and alloys, compounds and combinations thereof.

6. The carrying bag of claim 5, wherein the radiation shielding material includes tungsten, lead, or a combination thereof.

7. The carrying bag of claim 1, wherein the radiation shielding material is a composite material including:

a binder;

a High Z material distributed throughout the binder; and optionally, fibers distributed throughout the binder.

8. The carrying bag of claim 7, wherein the High Z material includes tungsten or lead at between about 5% and about 95% of the composite material by weight.

9. The carrying bag of claim 7, wherein the binder includes a polymer selected from the group consisting of polyvinyls, polyurethane prepolymers, celluloses, fluoropolymers, ethylene inter-polymer alloy elastomers, acetates, such as ethylene vinyl acetate, nylon, polyether imides, polyester elastomers, polyester sulfones, polyphenyl amides, polypropylene, polyvinylidene fluorides or thermoset polyurea elastomers, acrylics, homopolymers, acrylonitrile-butadiene-styrene copolymers, thermoplastic fluoro polymers, ionomers, polyamides, polyamide-imides, polyacrylates, polyaryl-sulfones, polybenzimidazoles, polycarbonates, polybutylene terephthalates, polyether imides, polyether sulfones, thermoplastic polyimides, thermoplastic polyurethanes, polyphenylene sulfides, polyethylene, polysulfones, polyvinylchlorides, styrene acrylonitriles, polystyrenes, polyphenylene ether blends, styrene maleic anhydrides, polycarbonates, cyanates, epoxies, phenolics, unsaturated polyesters, bismaleimides, polyurethanes, silicones, vinylesters, urethane hybrids, and combinations thereof.

10. The carrying bag of claim 7, wherein the binder comprises between about 2% to about 20% of the composite material by weight.

11. The carrying bag of claim 7, wherein the fibers are selected from the group consisting of stainless steel, copper, nickel, niobium, nickel, titanium, nylon, Kevlar™, Spectra™, glass, boron, or carbon, or combinations thereof.

12. The carrying bag of claim 1, wherein the radiation shielding material shields at least about 50% of the emission from the radiation source.

13. The carrying bag of claim 1, wherein the outer layer is formed from fabric.

14. The carrying bag of claim 1, further including an inner layer, the outer layer and the inner layers enclosing the lining.

15. The carrying bag of claim 1, further including:

a closure member for releasably closing the opening.

16. The carrying bag of claim 15, further including an upper panel connected with a rear panel member, the closure member comprising a hook and loop closure for selectively connecting the upper panel member to a front panel member.

17. The carrying bag of claim 1, wherein the bag has no rotatable members for wheeling the bag across a floor.

18. The carrying bag of claim 1, further including:

a stiffening layer which allows at least a portion of the bag to hold its shape while a flood source is inserted.

19. A method of transporting a radioactive source comprising:

placing the radioactive source in the bag of claim 1; and transporting the bag by grasping the handle with the hand.

20. The method of claim 19, wherein the step of transporting includes lifting the bag off the floor.

21. A carrying bag for transporting a flood source comprising:

a front panel member;

a rear panel member, the front and rear panel members being joined along base and side edges to define an interior space with an upper open end for receiving the radioactive source therein, the front and rear panel members each comprising:

an outer layer, an inner layer, and a lining formed from a radiation shielding material between the inner and outer layers;

an upper panel member shaped to cover the opening when the flood source is positioned within the interior space, the upper panel being connected with the rear panel member; and a closure member for selectively fastening the upper panel to the front panel to close the opening.

22. The carrying bag of claim 21, further comprising:

a first carrying member attached to the front panel member; and a second carrying member attached to the rear panel member.

23. The carrying bag of claim 21, further comprising:

a stiffening layer which allows at least a portion of the bag to hold its shape while a flood source is inserted.

24. A method of forming a bag for shielding a flood source comprising:

covering a sheet of a radiation shielding material with a sheet of fabric to form a radiation shielding panel;

folding the radiation shielding panel to define a front panel member, a rear panel member and a top panel member;

attaching the front panel member to the rear panel member along side edges thereof; and forming a closure member, a first portion of the closure member being associated with the top panel member, a second portion of the closure member being associated with the front panel member, the closure member being configured for selectively engaging the top panel member and front panel member.

25. The method of claim 24, further comprising:

providing at least one of the front panel member and rear panel member with a carrying handle.

* * * * *